US006186612B1

(12) United States Patent
Maeda et al.

(10) Patent No.: US 6,186,612 B1
(45) **Date of Patent: *Feb. 13, 2001**

(54) INK JET RECORDING METHOD AND RECORDING APPARATUS USING SAME

(75) Inventors: Hiroyuki Maeda, Yokohama; Isao Kimura, Kawasaki; Masako Shimomura, Yokohama; Hidemi Kubota, Inagi, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/825,127

(22) Filed: Mar. 27, 1997

(30) Foreign Application Priority Data

Mar. 27, 1996 (JP) ..... 8-072643
Mar. 18, 1997 (JP) ..... 9-064923

(51) Int. Cl.[7] ..... B41J 29/38
(52) U.S. Cl. ..... 347/17; 347/100
(58) Field of Search ..... 347/102, 100, 347/17, 19, 14

(56) References Cited

U.S. PATENT DOCUMENTS

| | | | | |
|---|---|---|---|---|
| 4,313,124 | | 1/1982 | Hara | 346/140 R |
| 4,345,262 | | 8/1982 | Shirato et al. | 346/140 R |
| 4,394,669 | * | 7/1983 | Ozawa et al. | 347/71 |
| 4,459,600 | | 7/1984 | Sato et al. | 346/140 R |

(List continued on next page.)

FOREIGN PATENT DOCUMENTS

| | | |
|---|---|---|
| 0 467 656 A2 | 1/1992 | (EP) . |
| 0 694 394 A1 | 1/1996 | (EP) . |
| 2 254 585 | 10/1992 | (GB) . |
| 54-56847 | 5/1979 | (JP) . |
| 59-123670 | 7/1984 | (JP) . |
| 59-138461 | 8/1984 | (JP) . |
| 60-32866 * | 2/1985 | (JP) . |
| 60-71260 | 4/1985 | (JP) . |
| 9-39381 | 2/1997 | (JP) . |
| WO 89 12215 | 12/1989 | (WO) . |

OTHER PUBLICATIONS

Patent Abstracts of Japan, vol. 18, No. 209 (C–1190) with respect to JP 06 009848 of Jan. 18, 1994.
Patent Abstracts of Japan, vol. 18, No. 282 (C–1205) with respect to JP 06 049399 A of Feb. 22, 1994.
Hawley's Chemical Dictionary, 13th edition, John Wiley & Sons, 1976, pp. 997.*

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

The ink jet recording apparatus of this invention comprises a means 67 for heating a record material to a predetermined temperature range at the position of recording, a recording head 41 for ejecting ink 46 from an ink ejection orifice 49 toward the record material to perform recording, the ink containing a substance having thickening properties when undergoing heat, and/or a substance having a cloud point for the heat; a means 69 for measuring the duration for which the recording head resides at the position of recording; and means for controlling the duration of residence in accordance with the properties of the ink to prevent the ejection function being impaired owing to the heating of the surroundings of the ink ejection orifice. This invention can provide an ink jet recording method which determines a rise in the temperature in the surroundings of the ink ejection orifice on the basis of the duration of residence of the recording head at the position of recording for the purpose of recording, and which performs control to suppress the temperature rise before the ejection function is interrupted.

24 Claims, 10 Drawing Sheets

U.S. PATENT DOCUMENTS

| | | | | |
|---|---|---|---|---|
| 4,463,359 | | 7/1984 | Ayata et al. | 346/1.1 |
| 4,514,540 | * | 4/1985 | Peck | 524/514 |
| 4,558,333 | | 12/1985 | Sugitani et al. | 346/140 R |
| 4,608,577 | | 8/1986 | Hori | 346/140 R |
| 4,723,129 | | 2/1988 | Endo et al. | 346/1.1 |
| 4,740,796 | | 4/1988 | Endo et al. | 346/1.1 |
| 5,495,271 | * | 2/1996 | Koitabashi et al. | 347/23 |
| 5,606,356 | * | 2/1997 | Noguchi et al. | 347/100 |
| 5,805,180 | * | 9/1998 | Ebisawa et al. | 347/22 |

INK JET RECORDING METHOD AND RECORDING APPARATUS USING SAME

BACKGROUND OF THE INVENTION

1. Field of the Invention

The present invention relates to an ink jet recording method and a recording apparatus using this method. More specifically, it relates to an ink jet recording method using ink capable of contributing to an improvement in the color expressibility of a recorded image, and a recording apparatus using this method.

2. Description of the Prior Art

An ink jet recording method converts ink, a recording liquid, into flying droplets by various methods, and causes them to land on a material to be recorded on, such as paper, to form an image in a dot-matrix format. This method involves low noise because it is a non-contact type. Furthermore, it is capable of a high-density, high-speed recording, and does not require a special treatment, such as development or fixing, for a material to be recorded on (hereinafter referred to as a record material), such as plain paper. A recording apparatus adopting this method is suitable for mass-production, and is available for a low price. In recent years, therefore, this type of recording apparatus has found widespread use. An on-demand ink jet recording apparatus, in particular, is easily available with color printing capability, and the machine itself can be downsized and simplified. Thus, such a recording apparatus is promising in terms of a future demand. With the spread of color printing, there is a growing desire for the color expressibility of an image recorded on a record material (to be also referred to as a record sheet).

We, the inventors of this invention, proposed in Japanese Patent Application No. 259023/1994 coloring materials, such as dyes or pigments, and a liquid medium for use in a recording liquid (hereinafter referred to as ink). In this application, we used ink containing a substance having thickening properties when undergoing heat, and in a narrow sense, a temperature sensitive polymer gelling thermally reversibly at its transition temperature or above, i.e., a temperature sensitive polymer gelling at its transition temperature or above and returning to a liquid state at a temperature below the transition temperature, and a substance which begins to cloud when undergoing heat (hereinafter referred to as a substance having a cloud point). This ink showed a sharply increased viscosity on the record sheet, and stably settled on the surface, achieving an improvement in color expressibility. As a method of sharply increasing its viscosity, we proposed controlled heating of the record sheet.

However, the distance between a recording head for ejecting ink and a record sheet is as small as less than several millimeters. Thus, the mere use of the above record sheet controlled heating means results in the fact that radiant heat from the heated record sheet is passed on to the surroundings of the ink ejection orifice of the opposed recording head which is doing a record action. As a result, the surroundings of the ink ejection orifice and the inside of the ink passage are liable to undergo increased temperatures. Especially when the recording head is performing a record action for a long time at a position opposed to the record sheet which has been heated in a controlled manner (hereinafter referred to as controlled-heated), the temperature in the surroundings of the ejection orifice is raised to the reaction temperature of the substance having thickening properties when undergoing heat, or the substance having a cloud point that is contained in the ink. Consequently, the substance having thickening properties when undergoing heat is gelled and precipitated at the parts around the ink ejection orifice or in the ink passage, or the substance having a cloud point forms an emulsion to increase the viscosity of ink, thereby occasionally hampering the ejection of ink.

SUMMARY OF THE INVENTION

We have focused on the above-described problem, and reached the concept of an ink jet recording apparatus which involves heating a record sheet at the position of recording because of the use of the aforementioned ink, and in which a rise in the temperature in the surroundings of an ink ejection orifice of a recording head is determined by the duration of residence of the recording head above a heated record sheet, and this increased temperature is lowered before the ejection function is hampered. The object of the present invention is to propose and provide an ink jet recording method for obtaining a satisfactory recorded image using the above ink based on this concept, and a recording apparatus employing this method.

To attain this object, the ink jet recording apparatus of the present invention comprises a transport means for guiding a record material to the position of recording and discharging it after recording; a record material heating means for controlled heating the record material guided to the position of recording by the transport means to a predetermined temperature range; a recording head for ejecting ink from an ink ejection orifice toward the record material to perform recording; a head residence time measuring means for measuring the duration for which the recording head resides at a position opposed to the record material controlled-heated for recording; and a control means for controlling the duration of residence of the recording head at a position opposed to the controlled-heated record material to prevent the ejection function of the recording head from being hampered because the temperature of the surroundings of the ink ejection orifice of the recording head exceeds a temperature at which the viscosity of the substance having thickening properties when undergoing heat in the ink and/or the substance having a cloud point sharply increases.

An ink jet recording method employing this recording apparatus comprises controlled-heating a record material, fed to the recording apparatus, to a predetermined temperature range; ejecting ink from an ink ejection orifice of a recording head toward the record material fed to the recording apparatus, to perform recording; and controlling the temperature of the surroundings of the ink ejection orifice of the recording head to prevent the ejection state of the recording head from being hampered owing to the rise in the temperature of the surroundings of the ink ejection orifice of the recording head caused by radiant heat from the controlled-heated record material.

In this method, the temperature of the surroundings of the ink ejection orifice of the recording head can be controlled to lie within the predetermined range, by controlling the duration of residence of the recording head at a position opposed to the heated record material. If the recording head is adapted to be cooled by a cooling fan or a Peltier device, however, it is possible to control the temperature of the surroundings of the ink ejection orifice of the recording head to lie within the predetermined range, even if the recording head keeps residing at a position opposed to the heated record material.

According to the present invention, when ink is ejected onto the heated record material for recording, the duration for which the recording head is resident in the record region is measured, with the temperature of the record material being detected. Based on the results, the surroundings of the ink ejection orifice of the recording head are cooled before the temperature of the surroundings impedes the ejection function of the recording head. Since recording is carried out using this procedure, a stable recorded image with a high degree of color expression can be obtained.

The above and other objects, effects, features and advantages of the present invention will become more apparent from the following description of embodiments thereof taken in conjunction with the accompanying drawings.

BRIEF DESCRIPTION OF THE DRAWINGS

FIG. 1 is a perspective view showing a structural example of an ink jet recording apparatus which the present invention is applicable to;

FIG. 2 is a sectional view showing a structural example of an ink cartridge which the invention is applicable to;

FIG. 3 is a perspective view showing a structural example of a recording head unit which the invention is applicable to;

FIG. 4A is a sectional view showing a structural example of a recording head portion which the invention is applicable to;

FIG. 5 is a sectional view showing another structural example of a recording head portion which the invention is applicable to;

FIG. 6 is a block diagram showing the structure of a control circuit the invention pertains to;

DETAILED DESCRIPTION OF THE PREFERRED EMBODIMENTS

Figure 1:
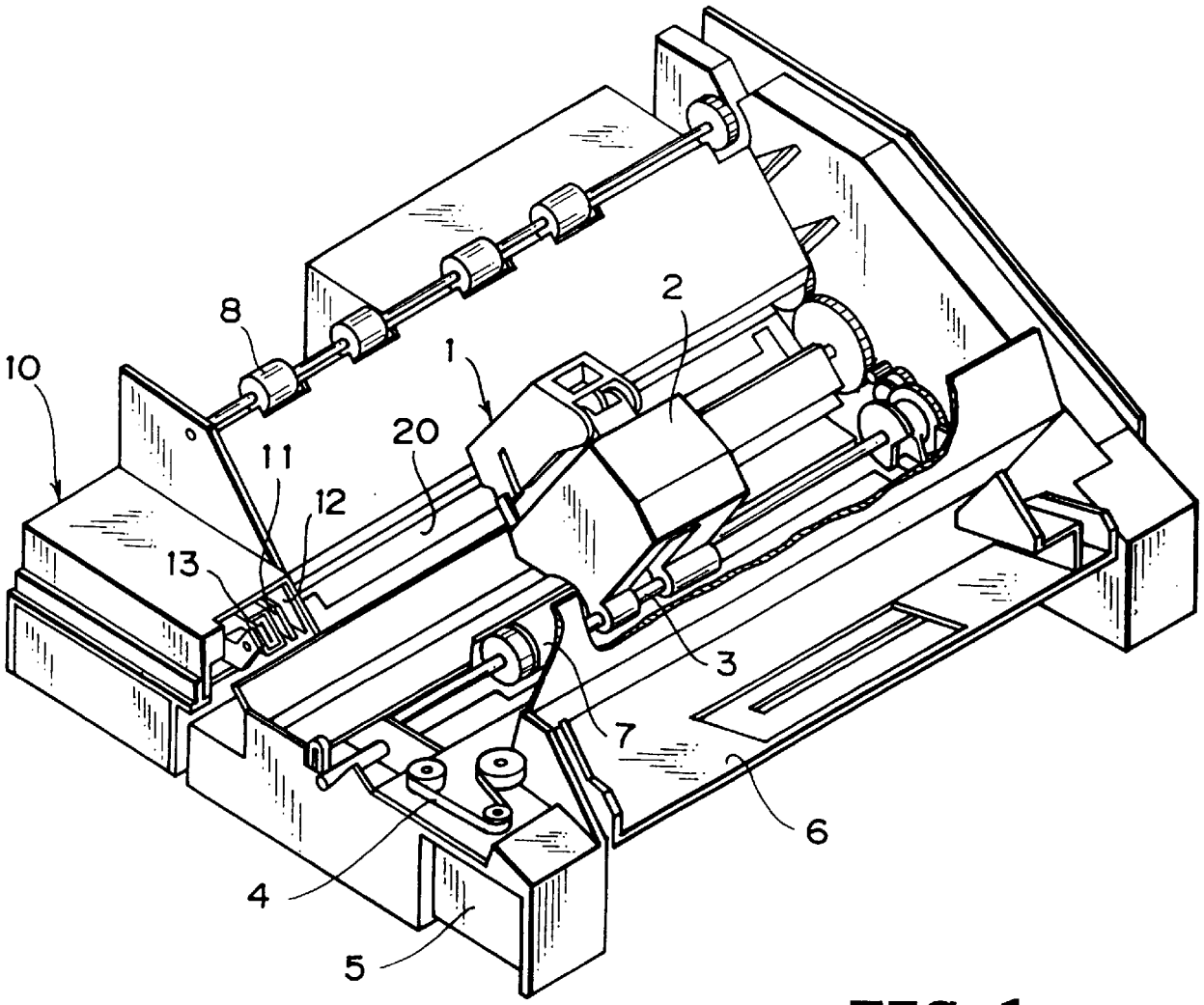

Preferred embodiments of the present invention will now be described in detail and in concrete form. Prior to the description, the characteristics of ink to be applied to the invention will be explained.

The ink for use in the invention is preferably the ink that contains a substance having thickening properties when undergoing heat in the predetermined temperature range, and/or a substance having a cloud point in the predetermined temperature range. However, the ink for use in the invention are not restricted to the ink mentioned above. The inks containing conventional coloring materials and solvent are also usable in the invention.

First, the substance having thickening properties when undergoing heat, and the substance having a cloud point that is used in the invention will be described.

The substance having thickening properties when undergoing heat, typically, refers to a polymer. This is a substance which is present as a water-soluble polymer dissolved and dissociated in ink below its transition temperature, but which, at the transition temperature or above, associates, one molecule with another, that is, combines and behaves like a single molecule, thereby increasing the viscosity of the ink, and which, below the transition temperature, releases from the association, thus decreasing the viscosity of the ink. However, the rate of association of the polymer on this occasion varies with the temperature, so that the viscosity of the ink at the transition temperature or above varies with the temperature. When the ink containing the polymer associated therewith lands on the sheet as the record material heated to a predetermined temperature range, the viscosity of the associated polymer is raised, and thus retained on the surface portion of the record sheet. The polymer which is not associated, on the other hand, is dissolved in the aqueous ink, and so has a decreased viscosity, penetrating into the record sheet.

The higher the rate of the associated polymer, therefore, the more the polymer remaining on the surface portion of the record sheet becomes. Combining a coloring material with this associated polymer can result in the formation of a high density coloring material layer on the surface portion of the record sheet.

By changing the amount of the polymer remaining on the record sheet according to a change in the temperature to change the thickness of the coloring material layer on the surface portion of the record sheet, it becomes possible to enhance the ability to form a medium color and achieve an improvement in color reproduction.

The use of the substance having thickening properties makes it possible to control the degree of penetration of the ink into the record material. Thus, the coloring material of the ink is made to remain at the top of the record material, thereby increasing color development.

The substance having a cloud point is a surfactant which itself has thermally reversible thickening properties, has a relatively low weight average molecular weight, and quickly changes in behavior. The cloud point referred to here is a temperature at which a clear solution begins to cloud in response to a change in temperature. At this cloud point, the viscosity of the ink varies with the temperature. By utilizing this characteristic, and employing the same recording method as involving the ink containing the thermally reversible type thickening polymer, it is possible for the surfactant-containing ink to form a coloring material layer with a high density on the surface portion of the record sheet.

Next, the thermally reversible type thickening polymer will be described as a typical example of the substance having thickening properties when undergoing heat, the preferred one for ink to be used in the ink jet recording apparatus of the present invention.

The thermally reversible type thickening polymer, as has been described, is a polymer whose aqueous solution or aqueous suspension thickens at a certain temperature (transition temperature) or above, and whose temperature-viscosity relationship is reversible. Preferred examples of this polymer are water-soluble vinyl polymers (A) which have, as a repeating unit, (a) a vinyl carboxylic acid ester of an alkylene oxide adduct of an active hydrogen compound having a nitrogen-containing ring, and which contain 50% by weight or more of this vinyl carboxylate (a). More preferred examples are compounds in which the vinyl carboxylic acid ester (a) is a methacrylic ester or acrylic ester of 1 to 20 mol ethylene oxide and/or propylene oxide adduct of (substituted) morpholine.

The active hydrogen compound having a nitrogen-containing ring is a compound having a nitrogen-containing ring and active hydrogen for adding an alkylene oxide to the nitrogen-containing ring. Examples include nitrogen-containing alicyclic compounds, such as those having an aziridine ring (aziridine, 2-methylaziridine), those having a pyrrolidine ring (pyrrolidine, 2-methylpyrrolidine, 2-pyrrolidone, succinimide), those having a piperidine ring (piperidine, 2-methylpiperidine, 3,5-dimethylpiperidine, 2-ethylpiperidine, 4-piperidinopiperidine, 4-pyrrolidinopiperidine, ethylpipecolinate), those having a piperazine ring (1-methylpiperazine, 1-methyl-3-ethylpiperazine), those having a morpholine ring (morpholine, 2-methylmorpholine, 3,5-dimethylmorpholine), e-caprolactam, and nitrogen-containing unsaturated cyclic compounds (3-pyrroline, 2,5-dimethyl-3-pyrroline, 2-hydroxylpyridine, 4-pyridylcarbinol, 2-hydroxypyrimidine).

Preferred examples are nitrogen-containing alicyclic compounds. More preferable examples are those having a piperidine ring and those having a morpholine ring. The most preferable examples are those having a morpholine ring.

As the alkylene oxide in the invention, ethylene oxide, propylene oxide or butylene oxide is preferred.

The transition temperature of the thermally reversible type thickening polymer can be adjusted easily by regulating the type of the alkylene oxide or the number of its molecules added. With ethylene oxide, for example, the larger the number of its molecules added, the higher the transition temperature. In the case of propylene oxide or butylene oxide, by contrast, the increase in the number of its molecules added results in a lower transition temperature. The number of molecules of alkylene oxide added is preferably 1 to 20 mols, more preferably, 1 to 5 mols.

The vinyl carboxylic acid ester (a) is a mixed ester of the above-mentioned alkylene oxide adduct with a vinyl carboxylic acid. Preferred examples of the vinyl carboxylic acid are methacrylic acid, acrylic acid (hereinafter referred to collectively as (meth)acrylic acid), maleic acid, vinylbenzoic acid, and derivatives thereof. More preferable are (meth)acrylic acid, and (meth)acrylic acid derivatives.

The above-described water-soluble vinyl polymer (A) is either a polymer of one or more types of the vinyl carboxylic acid ester (a), or a copolymer of one or more types of the vinyl carboxylic acid ester (a) with other vinyl monomer (b). It is sufficient for this polymer or copolymer to contain one or more types of the vinyl carboxylic acid ester (a) in an amount of 50% by weight or more as the repeating unit.

Preferred examples of the other vinyl monomer are hydroxyethyl (meth)acrylate, polyethylene glycol mono (meth)acrylate, (meth)acrylamide, N-hydroxymethyl (meth) acrylamide, N-vinyl-2-pyrrolidone, (meth)acrylic acid, maleic acid (or anhydride), styrenesulfonic acid, N,N-dimethylaminoethyl (meth)acrylate, N,N-diethylaminopropyl (meth)acrylate, methyl (meth)acrylate, butyl (meth)acrylate, glycidyl (meth)acrylate, N-butyl (meth)acrylamide, N-cyclohexyl (meth)acrylamide, (meth) acrylonitrile, styrene, vinyl acetate, vinyl chloride, butadiene, and isoprene.

In the monomers constituting the water-soluble vinyl polymer (A), the proportion of the vinyl carboxylic acid ester (a) governs changes in the temperature range for thickening. To minimize this temperature range, the proportion of the vinyl carboxylic acid ester (a) is preferably 50% by weight or more, more preferably 70% by weight or more, based on the entire water-soluble vinyl polymer (A).

When the above-mentioned polymer is made into an aqueous solution, the viscosity decreases as the temperature rises, until a certain transition temperature is reached. In excess of the transition temperature, the viscosity rises with a steep slope. Moreover, the temperature-viscosity relationship has little hysteresis.

As previously mentioned, the transition temperature can be easily adjusted to an arbitrary temperature by changing the type of the alkylene oxide in the vinyl carboxylic acid ester (a) constituting the thermally reversible thickening polymer, or the number of mols of the alkylene oxide added. Thus, the polymer can be applied to various recording heads whose temperature rise characteristics vary according to the shape of the head or the recording method.

The transition temperature of the thermally reversible type thickening polymer, however, varies with the type or amount of other components added, such as salt, surfactant or solvent, in the ink. Thus, the ink applied should employ the transition temperature suitable for the composition of the ink applied.

In the present invention, moreover, the molecular weight and the content of the thermally reversible type thickening polymer in the ink need to be such that the viscosity of the ink for ink jet recording will be within the permissible range (20 mPa.s or less). Thus, the weight average molecular weight of the polymer should better be in the range of from 2000 to 500,000. If the weight average molecular weight exceeds 500,000, the molecular chain will become so long that the redissolution rate lowers or stringiness appears. These are undesirable phenomena. When the weight average molecular weight is relatively low, say, about 2000, the thickening effect is weak, thus requiring an increased amount of the polymer. Preferably, 2 to 10% by weight of the polymer is added. When the weight average molecular weight is relatively high, say, close to 500,000, a small amount of the polymer added exhibits a full thickening effect. The preferred amount added is 0.005 to 5% by weight. In other words, the preferred amount of the thermally reversible type thickening polymer is such that the thermally reversible thickening effect is maximized and the viscosity of the entire ink does not exceed the permissible range for the ink viscosity for ink jet recording. In the present invention, the incorporation of the thermally reversible type thickening polymer with a different weight average molecular weight could provide the present invention with a sufficient effect.

The substance having a cloud point for use in the invention is typically a surfactant. It is such a surfactant that an aqueous solution or aqueous suspension containing this surfactant thickens and clouds at a certain temperature (cloud point Tc) or above, has a maximum point temperature Tp, the temperature at which the viscosity peaks, and has a viscosity lowering at a temperature above the maximum point temperature Tp, and whose temperature-viscosity relationship is reversible. As the surfactant, compounds indicated below are preferred.

(A) Higher alcohol-ethylene oxide addition type surfactants of the general formula (1)

$$R—O—(—CH_2—CH_2—O—)_n—H \quad (1)$$

where R represents an alkyl group having 8 to 22 carbon atoms, and n denotes an integer of 6 to 20.

(B) Propylene glycol-ethylene oxide addition type surfactants of the general formula (2)

(2)

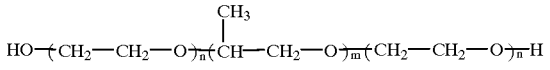

where m denotes an integer of 20 to 80, and n denotes an integer of 5 to 200.

When the surfactant is converted into an aqueous solution, the viscosity minimally varies but remains nearly constant as the temperature increases to up to the cloud point Tc. In excess of the cloud point Tc, the viscosity increases with a steep slope. However, as the temperature further rises, the maximum-viscosity point temperature Tp is reached. Above the temperature Tp, the viscosity lowers, and the rate of a drop in the viscosity, i.e., the rate of redissolution, is nearly equal to the rate of thickening, showing that the temperature-viscosity relationship has little hysteresis.

The cloud point Tc can be easily adjusted to an arbitrary temperature by changing the type of the alkylene oxide constituting the molecules of the surfactant, or the number of mols of the alkylene oxide added. Thus, the surfactant can be applied to various recording heads whose temperature rise characteristics vary according to the shape of the head or the recording method.

However, the cloud point Tc varies with the type or amount of the polymer used concurrently or other components added, such as salt, surfactant or solvent, in the ink. Thus, the cloud point Tc should be one suitable for the composition of the ink applied.

In the present invention, moreover, the constituent functional group of the surfactant added needs to be such that the viscosity of the ink for ink jet recording will be within the permissible range (20 mPa.s or less). Thus, the surfactant of the general formula (1) should preferably be one in which R is an alkyl group having 8 to 22 carbon atoms, and n denotes an integer of 6 to 20.

The surfactant of the general formula (2) should preferably be one in which the propylene glycol portion functions as a hydrophobic portion with its m being an integer of 20 to 80, while the ethylene oxide as a hydrophilic portion has the n being an integer of 5 to 200 (10 to 80 wt. % of all molecules).

As the proportion of the ethylene oxide in all molecules is raised, the cloud point Tc rises. Thus, the cloud point Tc can be freely set by changing the proportion of the ethylene oxide or the proportion of the propylene oxide.

The amount of the surfactant added into the ink can be set in a wide range, since its molecular weight is relatively small. However, the range of 0.1 to 10% by weight is preferred.

If its amount is less than 0.1% by weight, the thickening effect will be reduced. In an amount of more than 10% by weight, the ink will be too viscous and will penetrate into paper or the like too much, thereby lowering color development.

Even if the different surfactants of the formulae (1) and (2) are combined, the invention achieves a full effect, as long as their cloud points are close to each other.

The above-described compounds may be used alone or in combination. In either case, the intended effect is not affected.

The coloring materials for use in the ink of the invention may be known ones, which include the following direct dyes, acid dyes, basic dyes, reactive dyes, soluble dyes of food coloring matters, pigments, or insoluble color matters of disperse dyes.

Examples of water-soluble dyes are:

Direct dyes such as

C.I. Direct Black-17, -19, -22, -32, -38, -51, -62, -71, -108, -146 and -154;

C.I. Direct Yellow-12, -24, -26, -44, -86, -87, -98, -100, -130 and -142;

C.I. Direct Red-1, -4, -13, -17, -23, -28, -31, -62, -79, -81, -83, -89, -227, -240, -242 and -243;

C.I. Direct Blue-6, -22, -25, -71, -78, -86, -90, -106 and -199;

C.I. Direct Orange-34, -39, -44, -46 and -60;

C.I. Direct Violet-47 and -48;

C.I. Direct Brown-109; and

C.I. Direct Green-59;

Acid dyes such as

C.I. Acid Black-2, -7, -24, -26, -31, -52, -63, -112, -118, -168, -172 and -208;

C.I. Acid Yellow-11, -17, -23, -25, -29, -42, -49, -61 and -71;

C.I. Acid Red-1, -6, -8, -32, -37, -51, -52, -80, -85, -87, -92, -94, -115, -180, -254, -256, -289, -315 and -317;

C.I. Acid Blue-9, -22, -40, -59, -93, -102, -104, -113, -117, -120, -167, -229, -234 and -254;

C.I. Acid Orange-7 and -19;

C.I. Acid Violet-49;

Reactive dyes such as

C.I. Reactive Black-1, -5, -8, -13, -14, -23, -31, -34 and -39;

C.I. Reactive Yellow-2, -3, -13, -15, -17, -18, -23, -24, -37, -42, -57, -58, -64, -75, -76, -77, -79, -81, -84, -85, -87, -88, -91, -92, -93, -95, -102, -111, -115, -116, -130, -131, -132, -133, -135, -137, -139, -140, -142, -143, -144, -145, -146, -147, -148, -151, -162 and -163;

C.I. Reactive Red-3, -13, -16, -21, -22, -23, -24, -29, -31, -33, -35, -45, -49, -55, -63, -85, -106, -109, -111, -112, -113, -114, -118, -126, -128, -130, -131, -141, -151, -170, -171, -174, -176, -177, -183, -184, -186, -187, -188, -190, -193, -194, -195, -196, -200, -201, -202, -204, -206, -218 and -221;

C.I. Reactive Blue-2, -3, -5, -8, -10, -13, -14, -15, -18, -19, -21, -25, -27, -28, -38, -39, -40, -41, -49, -52, -63, -71, -72, -74, -75, -77, -78, -79, -89, -100, -101, -104, -105, -119, -122, -147, -158, -160, -162, -166, -169, -170, -171, -172, -173, -174, -176, -179, -184, -190, -191, -194, -195, -198, -204, -211, -216 and -217;

C.I. Reactive Orange-5, -7, -11, -12, -13, -15, -16, -35, -45, -46, -56, -62, -70, -72, -74, -82, -84, -87, -91, -92, -93, -95, -97 and -99;

C.I. Reactive Violet-1, -4, -5, -6, -22, -24, -33, -36 and -38;

C.I. Reactive Green-5, -8, -12, -15, -19 and -23; and

C.I. Reactive Brown-2, -7, -8, -9, -11, -16, -17, -18, -21, -24, -26, -31, -32 and -33;

C.I. Basic Black-2;

C.I. Basic Red-1, -2, -9, -12, -13, -14 and -27;

C.I. Basic Blue-1, -3, -5, -7, -9, -24, -25, -26, -28 and -29;

C.I. Basic Violet-7, -14 and -27; and

C.I. Food Black-1 and -2.

The above-cited examples of the coloring materials are particularly preferred for the ink of the invention. However, the coloring materials for use in the invention are not restricted to the above coloring materials.

The pigments shown below are also usable, because they do not affect the effect of the present invention.

Carbon blacks (Mitsubishi Chemical Industries' No. 2300, No. 900, MCF88, No. 33, No. 40, No. 45, No. 52, MA7, MA8, #2200B, MA-100; Columbia Carbon's Raven 1255, Raven 1060; Cabbot's Regal 3300R, Regal 660R, Mogul L; DEGUSSA's Color Black FW18, Printex 35, Printex U, etc.) whose surfaces are oxidized or plasma treated;

Organic pigments such as insoluble azo pigments, soluble azo pigments, phthalocyanine pigments, isoindolinone high grade pigments, quinacridone high grade pigments, dioxane violet, and perinone-perylene high grade pigments; and Inorganic pigments such as ultramarine, Prussian blue, titanium yellow and molybdenum red.

As coloring materials classified as the above pigments, color lakes produced by combining dyes with extender pigments can also be used as the coloring materials of the invention.

Such a coloring material is preferably used in a proportion of about 0.1 to 25% by weight based on the total amount of ink.

As the liquid medium, water, and if desired, a water-soluble organic solvent are used.

Examples of the water-soluble organic solvents are alkyl alcohols having 1 to 5 carbon atoms, such as methyl alcohol, ethyl alcohol, isopropyl alcohol, n-butyl alcohol, isobutyl alcohol, sec-butyl alcohol, tert-butyl alcohol, and n-pentanol;

amides such as dimethylformamide and dimethylacetamide;

ketones or ketols such as acetone or diacetone alcohol;

ethers such as tetrahydrofuran and dioxane;

polyalkylene glycols such as polyethylene glycol and polypropylene glycol;

alkylene glycols such as ethylene glycol, propylene glycol, butylene glycol, triethylene glycol, 1,2,6-hexanetriol, thiodiglycol, hexylene glycol, and diethylene glycol;

lower alkyl ethers of polyhydric alcohols, such as ethylene glycol methyl ether, diethylene glycol monomethyl ether, and triethylene glycol monomethyl ether; and others such as glycerin, N-methyl-2-pyrrolidone, 1,3-dimethyl-2-imidazolidinone, monoethanolamine, triethanolamine, sulfolane, dimethyl sulfoxide, urea, and 1,3-bis(b-hydroxyethyl)urea.

The proportion of any of these water-soluble organic solvents in the ink is not restricted, but generally, is 1 to 80% by weight, preferably 2 to 60% by weight, based on the total amount of the ink.

The water content of the ink is determined widely depending on the type of the solvent, the composition, and so forth. Generally, it is 10.0 to 98.0% by weight, preferably 35.0 to 95.0% by weight, based on the total amount of the ink.

The ink of the invention may, if desired, further contain other additives such as dispersants, viscosity adjustors, pH adjustors, preservatives, antioxidants, wetting agents, and other surfactants, unless they impair the properties of the ink. If the production cost is emphasized, they need not be used. Examples of the other additives are viscosity adjustors such as polyvinyl alcohol, celluloses, and water-soluble resins, surface tension adjustors such as diethanolamine and triethanolamine, pH adjustors using buffer solutions, and antifungals.

The ink of the invention preferably has a viscosity at 25° C. of 1 to 20 mPa.s, a surface tension of 20 mN/m or more, and a pH of about 6 to 10.

The above-described ink is effective for enhancing color expressibility, when used in ink jet recording the invention pertains to.

Next, structural examples of an ink jet recording head and an ink jet recording apparatus concerned with the invention in which the above-mentioned ink is supplied with ejection energy to eject ink droplets for recording will be described with reference to FIGS. 1 to 6. The recording head of the inventive ink jet recording apparatus to be exemplified below may be one of the type which ejects ink using heat energy, or one of the type which ejects ink using the kinetic energy of a piezoelectric device.

FIG. 1 shows an example of the structure of the ink jet recording apparatus. The numeral 1 denotes a recording head unit, 2 a carriage for bearing the recording head unit 1 and making a scan while moving along a side shaft 3. The numeral 4 represents a timing belt connected to the carriage 2 to move the carriage 2, and 5 shows a carriage drive motor. A record sheet (not shown) is fed by a feed roller 7 from a feed portion 6, and guided to a position opposed to the surface of ink ejection of the recording head unit 1, where recording is performed. Then, the record sheet is transported by a transport means (not shown) each time a main scan by the carriage 2 is made, whereupon the sheet is discharged to the outside of the machine by a discharge roller 8.

The numeral 10 is an ejection recovery portion for maintaining and recovering the ejection function of the recording head in association with the ink ejection surface of the recording head of the recording head unit 1. The numeral 11 is a blade member for cleaning the ink ejection surface. The numeral 12 is an ink absorbent for absorbing and holding the ink wiped off with the blade member 11. The numeral 13 is a cap member which contacts the ink ejection surface to prevent the evaporation of ink and take up the heat in the surroundings of the ejection orifice of the heated recording head, and receives ink discharged from the ink ejection orifice by use of a suction means (not shown). Desirably, the cap member 13 is formed of a material having a high heat-absorbing capacity suitable for cooling the head as will be described later. The ejection recovery portion 10, composed of the blade member 11, ink absorbent 12 and cap member 13, cleans off a possible hindrance to recording, such as ink or debris adhering to the ink ejection orifice surface of the recording head, as well as sucks thickened ink to recover the ejection function, and contributes to cooling of the surroundings of the ejection orifice as will be described later.

The numeral 20 is a platen for holding the record sheet at the position of recording. In the instant embodiment, the record sheet is heated at the position of recording to cause the association of the molecules of the polymer contained in the ink ejected onto the record sheet and evaporate the penetrating solvent, thereby changing the thickness of the coloring material layer and improving the expressibility of color. The heating temperature should be held in a range of not lower than the transition temperature or cloud point of the thermally reversible type thickening polymer and/or the surfactant having the cloud point in the ink, but less than the temperature at which the record material will deteriorate. The temperature at which the record material will deteriorate, mentioned here, refers to a temperature at which the record material yellows or deforms owing to heat. Heating for this purpose is achieved, for example, by providing the platen 20 itself or its back side with a sheet heating portion (not shown), and actuating the sheet heating portion simultaneously with a record start command to heat the record sheet to a predetermined temperature range of from 35° C. to 100° C. The sheet heating portion may be of any type, such as a thermal head, an infrared heater, a lamp heater or a heating coil, whose temperature can be controlled suitably. The predetermined temperature range is, say, 25 to 200° C. when the record sheet is directly heated with a ceramic heater provided on the platen; or 25 to 80° C. when the record medium is heated with a far-infrared heater via air.

Figure 2:
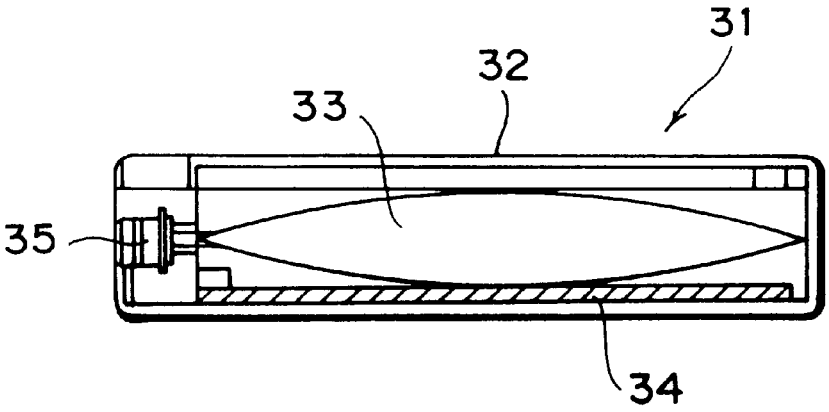
Figure 3:
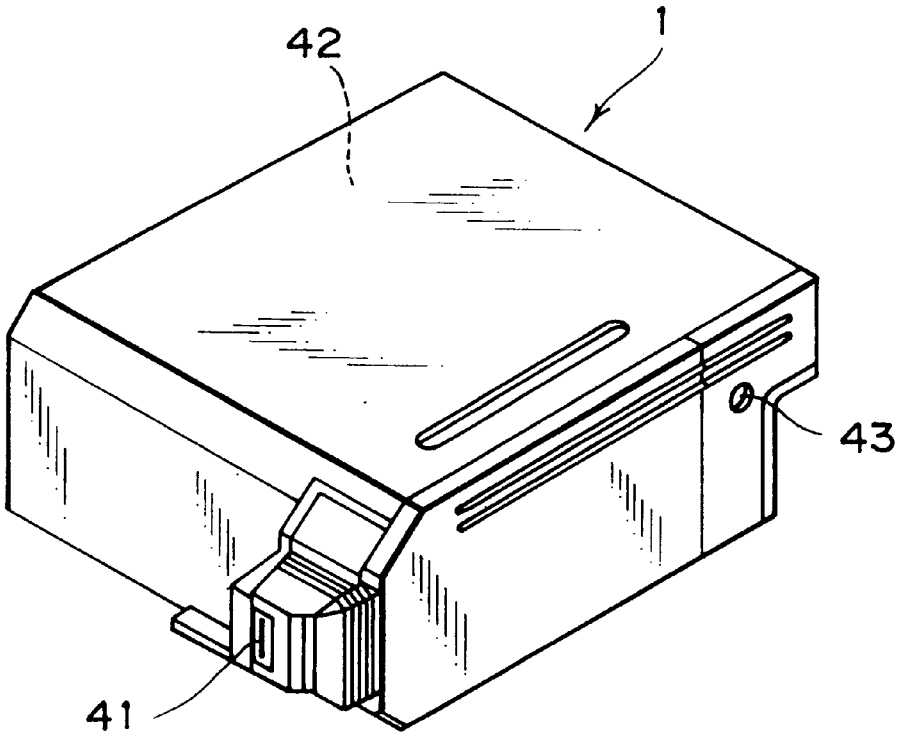

FIG. 2 shows a structural example of an ink cartridge 31 built into the recording head unit 1. The ink cartridge 31 has a housing 32 for holding an ink bag 33 of a flexible material whose inner surface in direct contact with ink is formed of polyolefin, preferably, polyethylene and which accommodates ink, and a waste ink absorbent 34 for absorbing ink discharged from the recording head side. The numeral 35 is a stopper formed integrally with the ink bag 33 to supply ink from the ink bag 33 to the recording head side. The stopper 35 is formed of, say, an elastic body, and when fitted with a needle-shaped supply nozzle (not shown), the stopper 35 can be connected to the recording head side to supply ink. The ink cartridge is not restricted to this type, but may be of the type shown in FIG. 3 in which a recording head portion 41 and an ink accommodation portion (ink tank portion) 42 are integrally constructed. With this recording head unit 1, the numeral 43 is an air communicating opening which allows communication with the ink tank portion 42 inside.

Figure 4A:
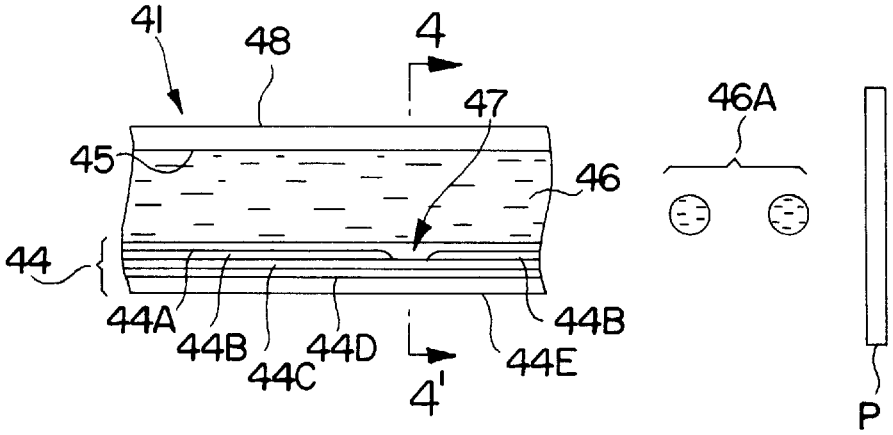
Figure 4B:
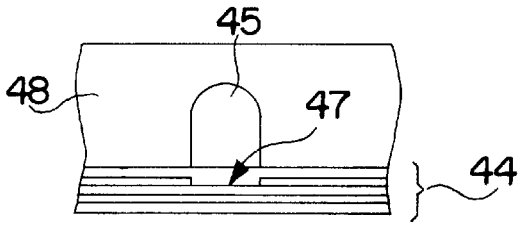
FIG. 4B is a sectional view taken on line 4–4' FIG. 4A.
Figure 4C:
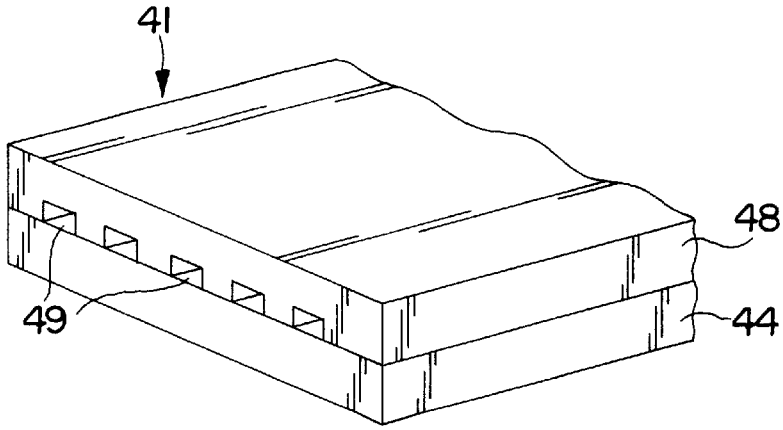
FIG. 4C is a perspective view showing the contour of the record head portion.

The structure of recording head portion 41 will be described by reference to FIG. 4, in which (B) is a sectional view taken on line 4–4' of (A), and (C) shows the outline of the contour. As illustrated in FIG. 4(A), the recording head portion 41 comprises a liquid passage 45 provided on a heat generation element substrate 44, a heat generation element 47 for generating heat energy as ejection energy for ink 46 in the liquid passage 45, and a top plate 48 covering the liquid passage 45. The numeral 49 is an ink ejection orifice, and 46A is an ink droplet ejected from the ink ejection orifice 49 and flying toward a record sheet P. The heat generation element substrate 44 is composed of a protective layer 44A formed of silicon oxide, silicon nitride or silicon carbide, an electrode 44B formed of aluminum, gold, or an aluminum-copper alloy, a heat generation resistor layer 44C formed of a high melting point material such as $HfB_2$, TaN or TaAl, a heat accumulation layer 44D formed of thermally oxidized silicon or aluminum oxide, and a substrate material 44E formed of a material with satisfactory heat dissipation, such as silicon, aluminum or aluminum nitride.

Figure 5:
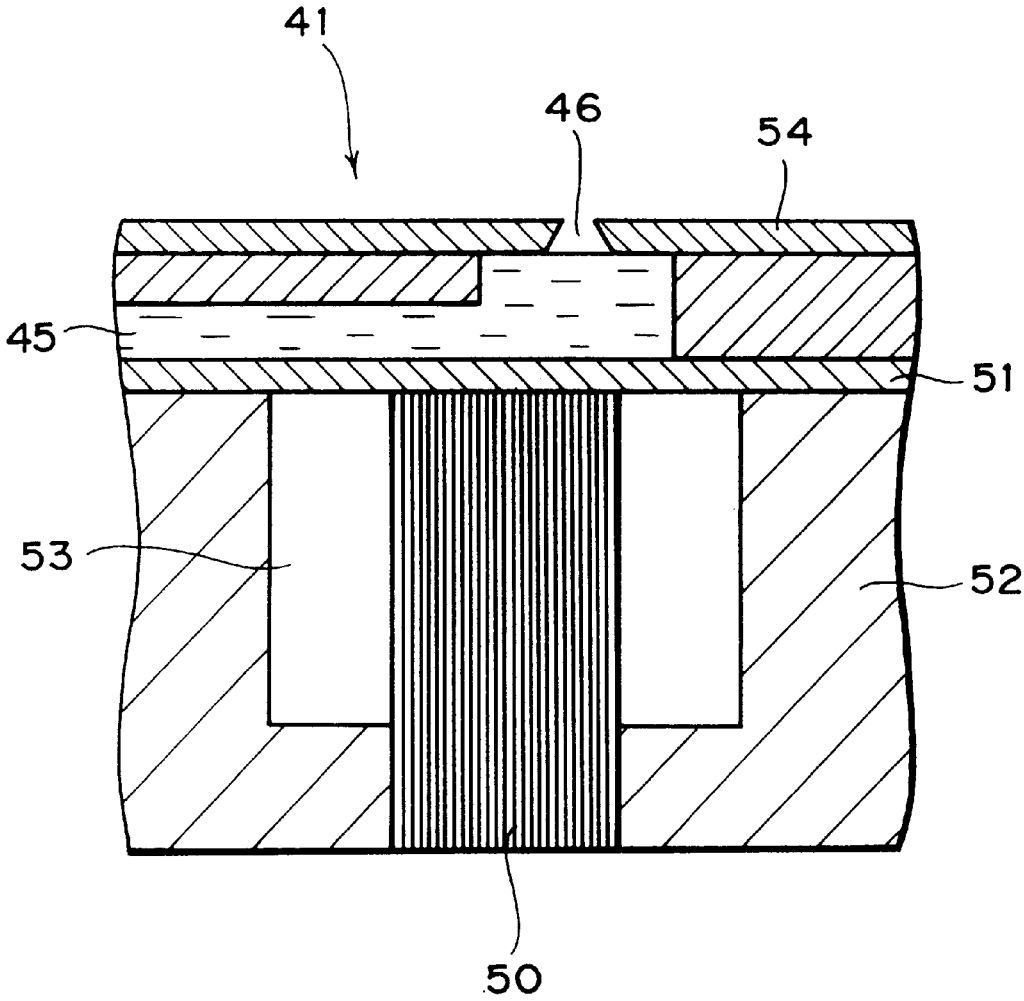

FIG. 5 shows a structural example of recording head portion 41 using a piezoelectric element as a mechanical ejection energy generation element. The numeral 50 is a piezoelectric element. The numeral 51 is an oscillating plate which oscillates in response to the expansion and contraction of the piezoelectric element 50. The numeral 52 is a substrate. The numeral 53 is a space formed in the substrate 52 for allowing the displacement of the oscillating plate 51 according to the expansion and contraction of the piezoelectric element 50. The numeral 54 is an orifice plate where the ink ejection orifice 46 is formed. The orifice plate 54 is formed of a metallic material such as stainless steel or nickel, and is pierced with a plurality of ink ejection orifices 46. The oscillating plate 51 is formed of a metallic film of stainless steel, nickel or titanium, or a high elasticity plastic film. The piezoelectric element 50 is formed of a dielectric material such as barium titanate or PZT. The liquid passage 45 communicates with a common liquid chamber (not shown). These parts are produced by a known semiconductor technology using a photosensitive plastic material or the like.

In the recording head portion 41 of the foregoing constitution, the piezoelectric element 50 disposed at a position opposed to the ejection orifice 46 of each liquid passage 45 is selectively driven by a pulse-voltage drive signal to undergo stress, thereby displacing the oscillating plate 51. This displacement pressurizes the ink in the liquid passage 45 to eject the ink as a droplet through the ink ejection orifice 46.

With the above-described ink jet recording apparatus, only its basic structure has been explained, and its structure for color recording has not been described. However, this recording apparatus can be constructed as is a known color recording apparatus.

Figure 6:
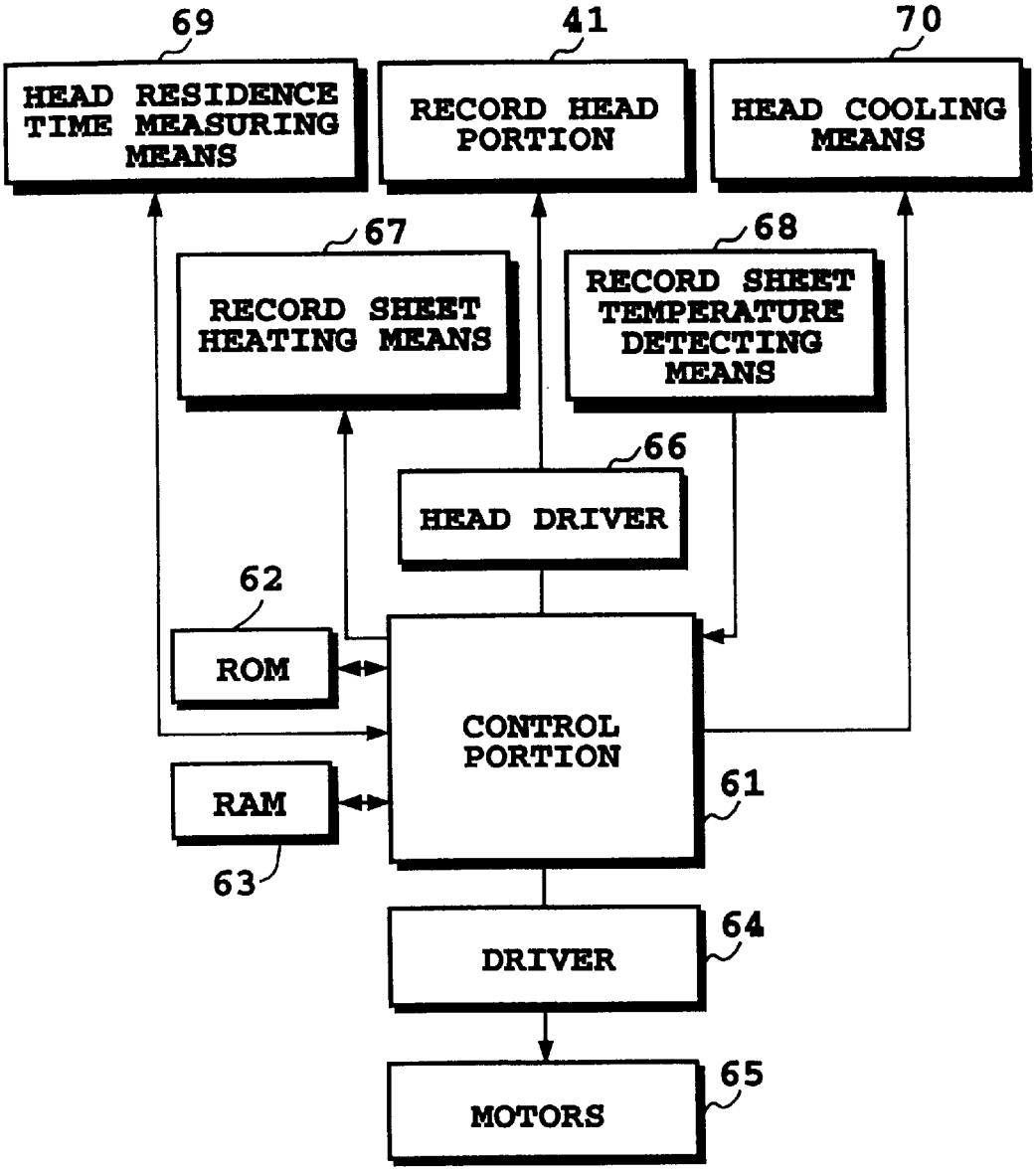

The structure of a circuit for control of recording in the invention is shown in FIG. 6. The numeral 61 is a control portion, 62 is a recording apparatus ROM for storing various control programs, including that concerned with the invention, and 63 is a refreshable recording apparatus RAM that stores record data temporarily. The control portion 61 drives motors 65, such as the carriage drive motor 5 and a transport motor, via a driver 64. The control portion 61 also drives the recording head portion 41 via a head driver 66 to carry out recording.

The numeral 67 is a record sheet heating means for heating the record sheet P held at the position of recording to a predetermined temperature range. The numeral 68 is a record sheet temperature detecting means for detecting the temperature of the heated record sheet. The numeral 69 is a means of measuring the period of time during which the recording head portion 41 continues recording along the record sheet P heated by the record sheet heating means 67, i.e., the time of residence of the recording head portion 41 at a position opposed to the record sheet P, the means being called head residence time measuring means. The head residence time measuring means may be one for measuring the time during which recording is made by the recording head along the region where the record sheet heating means 67 is installed.

The numeral 70 is a head cooling means, which may be one utilizing the ink absorbing action of the head recovery portion 10 illustrated in FIG. 1. Its cooling action will be described in detail later. The record sheet heating means 67 is disposed, for example, on the platen 20 itself which holds the record sheet, or on the back side of the platen 20, as has been described with reference to FIG. 1.

Embodiments

Embodiments of the present invention will be described. Tables 1 and 2 below show examples of the polymer having thermally reversible type thickening properties and the surfactant having a cloud point permitting effective thickening, the polymer or ink being contained in the ink used in the embodiments.

TABLE 1

Polymers exhibiting thermally reversible type thickening properties

| Symbol | Compound | Molecular weight | Viscosity of 5% aqueous solution (mPa · s) (at 30° C.) | Transition temperature Ts (° C.) |
|---|---|---|---|---|
| A | Morpholinoethyl methacrylate | 500,000 | 80 | 35 |
| B | 2-(2-Morpholinoethoxy)ethyl methacrylate | 300,000 | 15 | 56 |
| C | Morpholine ethylene oxide (3 mols)-methacrylic acid ester | 8,000 | 2 | 65 |
| D | Morpholine ethylene oxide (3 mols)-methacrylic acid ester | 200,000 | 10 | 65 |
| E | 3,5-Dimethylmorpholine ethylene oxide (4 mols)-methacrylic acid ester | 40,000 | 6 | 75 |
| F | 2-Morpholinopropyl methacrylate | 200,000 | 7 | 48 |

TABLE 2

Surfactants having cloud points for use in the present invention

| Symbol | Compound | Trade name | Cloud point Tc (° C.) |
|---|---|---|---|
| S-1 | Higher alcohol-EO adduct | Noniballsoft D070 | 47 |
| S-2 | Higher alcohol-EO adduct | Noniballsoft SS90 | 56 |
| S-3 | Higher alcohol-EO adduct | Noniballosft SDH90 | 69 |
| S-4 | Propylene glycol-EO adduct n = 5, m = 29 | Newball PE62 | 30 |
| S-5 | Propylene glycol-EO adduct n = 15, m = 35 | Newball PE74 | 55 |
| S-6 | Propylene glycol-EO adduct n = 23, m = 36 | Newball PE75 | 69 |

EO is short for ethylene oxide.
The surfactants are all products of Sanyo Chemical Industries, Ltd.

The ink was prepared in the following manner after preparing an aqueous solution of the polymer in demineralized water having a suitable concentration (10 to 40%): To an aqueous solution of the polymer, demineralized water, a solvent, an aqueous solution of the dye, and the surfactant having a cloud point were added in this order with stirring so as to be adjusted to a predetermined concentration for each composition. After 3 hours of stirring, the system was filtered through a membrane filter with a pore size of 0.45 μm, to produce inks of Examples 1 to 7 shown in Table 3.

TABLE 3

Compositions of ink used

| Component | C.I. Direct Black 19 | 1,2-Ethanediol | 2-Propanol | Urea | Polymer | Amount added | Surf-actant | Amount added | Demine-ralized water |
|---|---|---|---|---|---|---|---|---|---|
| Ex. 1 | 3.0 | 15.0 | 2.0 | — | A | 0.5 | S-4 | 5.0 | Remainder |
| Ex. 2 | 3.0 | 15.0 | 2.0 | 3.0 | B | 2.0 | S-2 | 5.0 | Remainder |
| Ex. 3 | 3.0 | 15.0 | 2.0 | — | C | 5.0 | S-3 | 5.0 | Remainder |
| Ex. 4 | 3.0 | 15.0 | 2.0 | — | D | 2.0 | S-6 | 5.0 | Remainder |
| Ex. 5 | 3.0 | 15.0 | 2.0 | — | B | 2.0 | S-5 | 5.0 | Remainder |
| Ex. 6 | 3.0 | 15.0 | 2.0 | — | F | 3.5 | S-1 | 5.0 | Remainder |
| Ex. 7 | 3.0 | 15.0 | 2.0 | 3.0 | E | 5.0 | — | — | Remainder |

Figure 7:
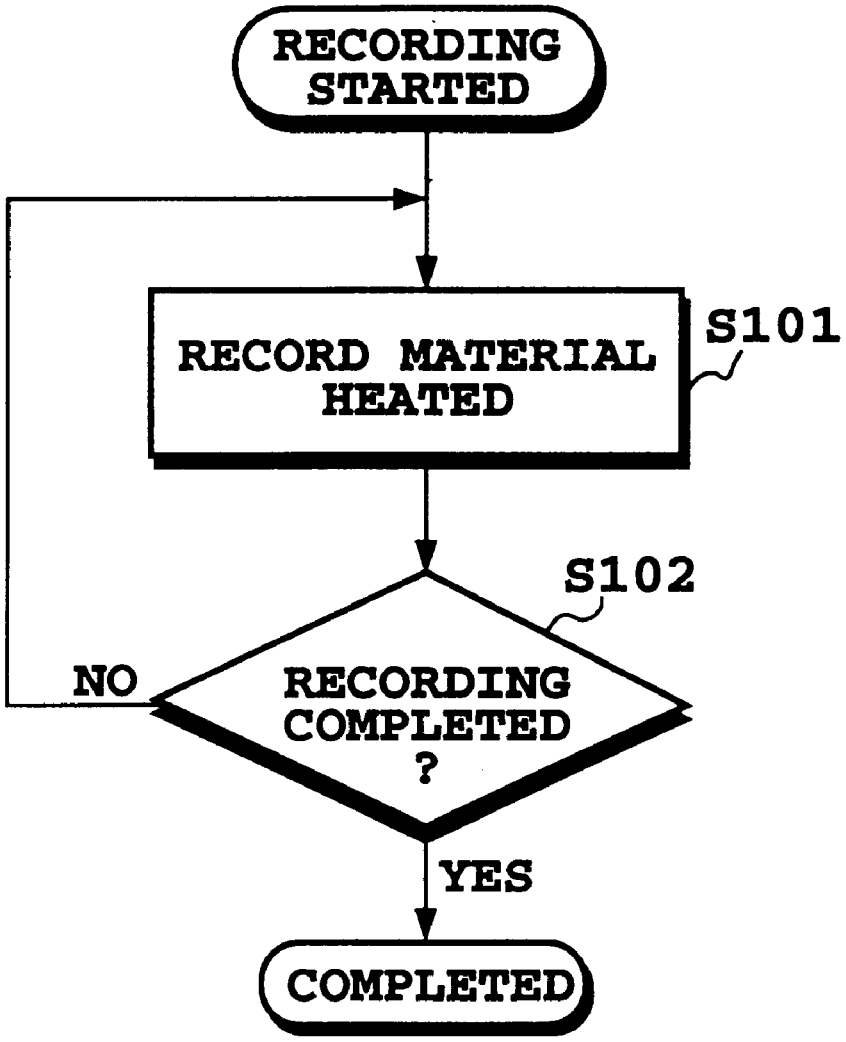
FIG.7 (PRIOR ART)
FIG. 7 is a flowchart showing the procedure of a control action during recording using a conventional example.

As a comparative example, FIG. 7 illustrates the conventional procedure for recording with the ink shown in Table 3 while heating a record sheet. With the conventional method, as shown in this flow chart, a record material (record sheet) was heated by record sheet heating means 67 at step S101 in accordance with a record start signal. Then, at step S102, it was determined whether continuous recording on the record sheet was completed or not. Recording by the recording head was continued until completion of recording, with only the determination step taken beforehand. As has been discussed, this method sometimes did not enable the ink of the invention to fully express a stable color.

Figure 8:
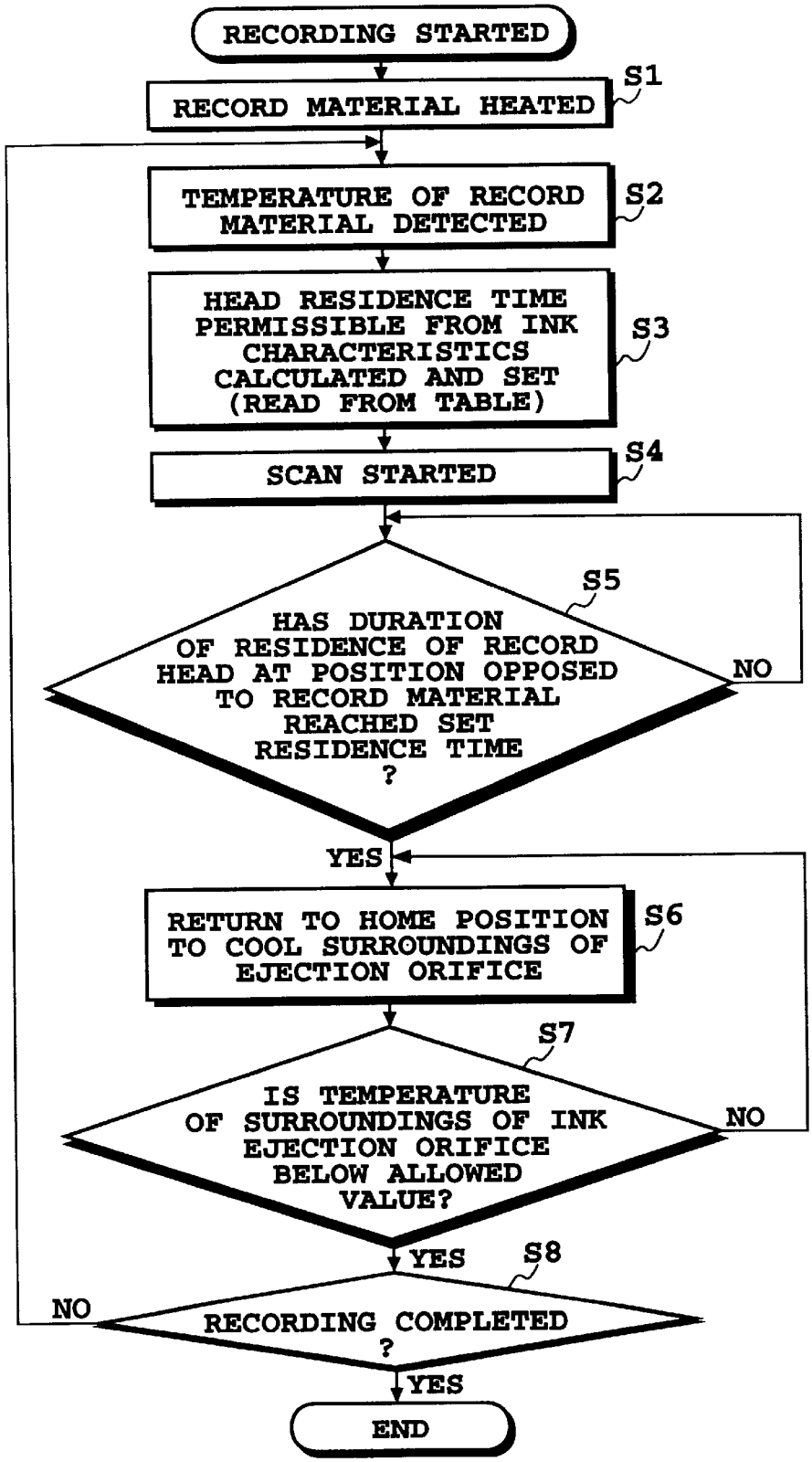
FIG. 8 is a flowchart showing the procedure of a control action during recording using an embodiment of the present invention.

FIG. 8 illustrates the procedure for a control action according to the embodiment of the invention. At a recording start command (or power-on), the sheet is heated by record sheet heating means 67 at step S1. At step S2, the temperature of the record sheet is detected by the temperature detecting means 68. Instead of detecting the temperature of the record sheet itself, the heating temperature of the record sheet heating means 67 itself may be detected. Thus, the record sheet is held in a temperature range not lower than the transition temperature or cloud point of the substance having thickening properties when undergoing heat in the ink (the thermally reversible type thickening polymer) and/or the surfactant having the cloud point; but below the temperature at which the record material deteriorates. Then, at step S3, the recording head residence time allowable according to the properties of the ink used in the instant embodiment (the duration for which the recording head can be resident at a position opposed to the record material without causing the thickening of the ink) is set, for instance, by reading from a table. At step S4, the carriage 3 is driven, and recording is made during its main scan. Simultaneously, the period of time during which the recording head portion 1 resides at the position opposed to the heated record sheet 49 is measured by the head residence time measuring means 69.

This period of time can be measured from the number of continuous scans based on the speed and acceleration of the carriage which is making a scan. Generally, it suffices that the period of time is measured by a timer from the duration of continuous recording plus the duration of a plural number of sheet feeds, including the wait time at the reversal of the scan direction. Means of time measuring for this purpose may be any means, as long as it does not deviate from the gist of the invention.

At a subsequent step S5, it is determined whether the residence time measured by the head residence time measuring means 69, i.e., the duration for which the recording head resides at a position opposed to the record material, has reached the time set at the step S3 or not. If negative, the scan is continued until the set time is reached. When it is determined that the residence time has reached the set time, the procedure goes to step S6, because further recording by the recording head may cause deposition of the temperature-sensitive gelable polymer onto the surroundings of the ink ejection orifice, thus hampering recording. At the step S6, the carriage 3 is driven to guide the recording head unit 1 to the position opposed to the cap member 13. Thus, the ink ejection orifice surface is covered with the cap member 13 to cool the surroundings of the ink ejection orifice. Alternatively, an ink suction/recovery action may be performed by the suction means to guide fresh ink to each liquid passage to cool the surroundings of the ink ejection orifice.

At the step S6, moreover, a pre-ejection action for ejecting ink from all ink orifices 49 may be performed by driving the recording head portion 41 instead of the ink suction/recovery action, whereby the hot ink is discharged from the recording head to cool the surroundings of the ink ejection orifices. Then, step S7 is carried out to determine whether or not the temperature of the surroundings of the ink ejection orifice has fallen below the allowed value, namely, the temperature at which the polymer in the ink does not precipitate. If negative, a drop in the temperature is waited for. However, it is necessary to interrupt the heating of the record material during the action ranging from the step 6 to step S8, or complete the action from the step 6 to step S8 in a short time. Unless this procedure is performed, heat to the record material is accumulated, potentially deteriorating the record material. At step S8, it is determined whether recording has been completed or not. If negative, the procedure returns to the step S2 to repeat the subsequent steps. If a determination of completion of recording is made at the step S8, this flow for control ends.

Table 4 shows the results of performance evaluation of recording carried out in accordance with the above-described procedure using the inks mentioned above. This performance evaluation was made by a panel of 10 evaluators by the following criteria: "○" when all 10 evaluators evaluated that the grade of recording was not impaired from the start of recording to its completion; and "Δ" when even one of the 10 evaluators made the evaluation that the grade of recording was impaired to the slightest degree. The temperature of the record sheet heating means was adjusted such that the surface temperature of the record sheet would be the cloud point Tc of the surfactant contained in the ink of each of Examples 1 to 7. The distance from the heating means built into the platen 20 to the surface of the record sheet was set at 0.5 mm. The record sheet was electrophotographic NP paper (Catalog Lot No. OKK10, Canon Sales Co., Inc.), standard paper for office work.

TABLE 4

| Ink | Conventional Recording method | Recording method of the invention |
|---|---|---|
| Ex. 1 | Δ | ○ |
| Ex. 2 | Δ | ○ |
| Ex. 3 | Δ | ○ |
| Ex. 4 | Δ | ○ |
| Ex. 5 | Δ | ○ |
| Ex. 6 | Δ | ○ |
| Ex. 7 | Δ | ○ |

With the above-described Examples, each of Examples has been explained in the case that the ink contains a substance having thickening properties when undergoing heat in the predetermined temperature range, and/or a substance having a cloud point in the predetermined temperature range. However, the ink for use in the invention are not restricted to the ink mentioned above. The inks containing conventional coloring materials and solvent are also usable in the invention. Even in the case that the conventional ink is used, in the invention, the temperature of the surroundings of the ink ejection orifice of the recording head can be controlled to lower before the ejection function is hampered.

When some ink ejection orifices have not been in use for a long time, solvent in the ink is promoted to evaporate, and viscosity of the ink is increased to lower fluidity of the ink, as the result of this, the orifices lose their ink-ejecting-ability. Even in these case, in the invention, the ink-ejecting-ability of the recording head can be improved.

The present invention achieves a distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

Figure 9:
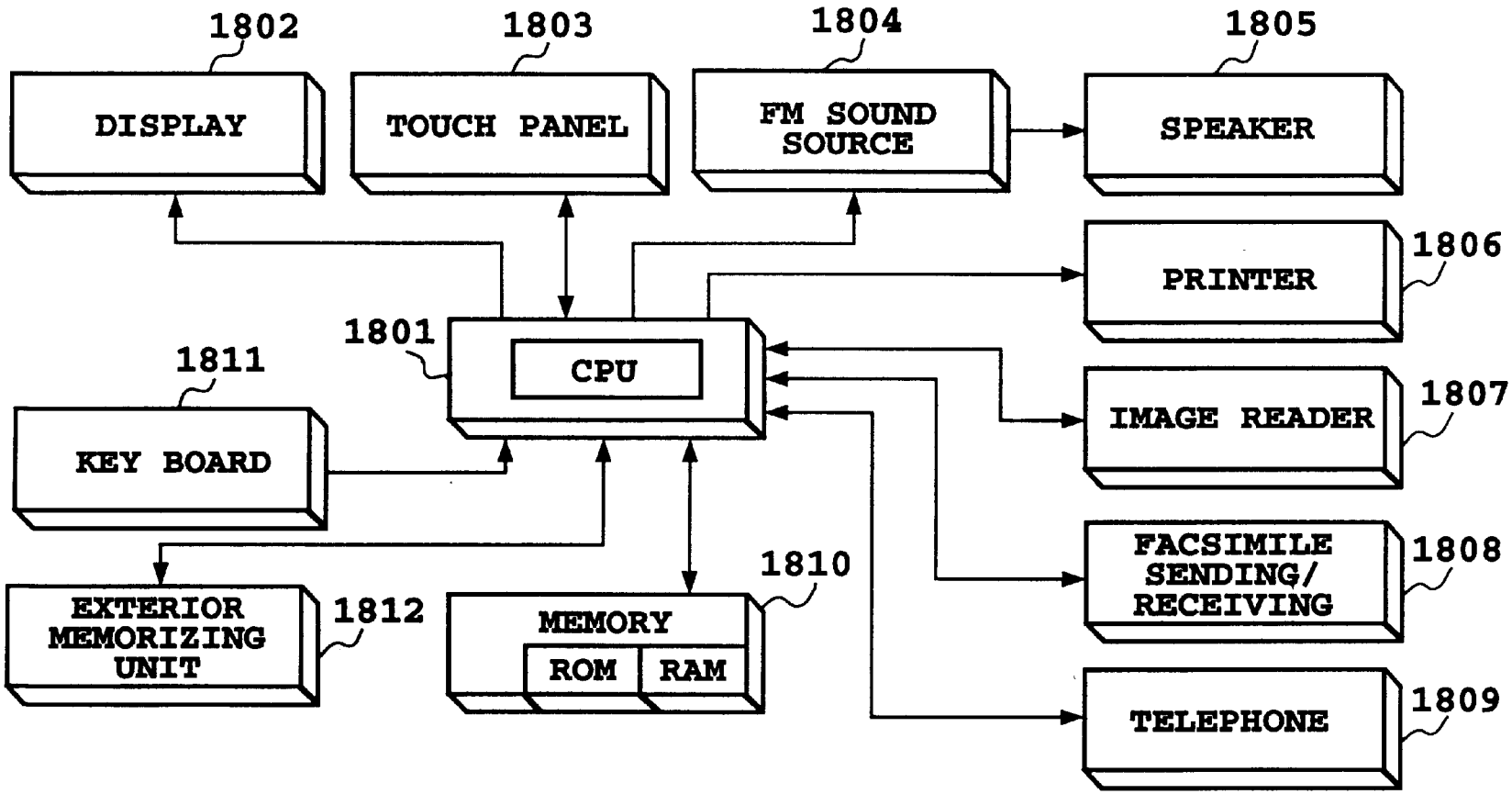
FIG. 9 is a block diagram showing general construction in which the recording apparatus of the present invention is applied to an information processor.

FIG. 9 is a block diagram showing general construction of an information processing apparatus having a function of wordprocessor, personal computer, facsimile machine, a copy machine and so forth, to which the printing apparatus according to the present invention is applied.

In the drawings, a reference numeral 1801 denotes a control portion performing control of the overall apparatus, which includes CPU, such as microprocessor and so forth, and various I/O port, to perform control for outputting control signal or data signal and so forth to respective portions and inputting control signal or data signal from the respective portions. A reference numeral 1802 denotes a display portion having a display screen, on which various menu, document information and image or so forth read by an image reader 1807 are displayed. A reference numeral 1803 denotes a transparent pressure sensitive touch panel provided on the display portion 1802 for performing item entry or coordinate portion entry on the display portion 1802 by depressing the surface thereof by a finger or so forth.

A reference numeral 1804 denotes a FM (frequency modulation) sound source portion which stores music information produced by a music editor and so forth in a memory portion 1810 or an external memory 1812 and performs FM modulation by reading out the stored music information from the memory portion or so forth. An electric signal from the FM sound source portion 1804 is transformed into an audible sound by a speaker portion 1805. A printer portion 1806 is employed as an output terminal of the wordprocessor, the personal computer, the facsimile machine, the copy machine and so forth, in which the printing apparatus according to the present invention is applied.

A reference numeral 1807 denotes an image reader portion for optoelectrically read out an original data for inputting, which is located at the intermediate position in an original feeding path and performs reading out various original document, such as original document for facsimile machine or copy machine. A reference numeral 1808 denotes a facsimile (FAX) transmission and reception portion for transmitting original data read by the image reader portion or for receiving transmitted facsimile signal, which facsimile transmission and reception portion has an external interface function. A reference numeral 1809 denotes a telephone machine portion having a normal telephone function and various associated functions, such as a recording telephone and so forth.

A reference numeral 1810 denotes a memory portion including a ROM storing a system program, a manager program, other application program and so forth, as well as character fonts, dictionary and so forth, a RAM for storing application program loaded from an external storage device 1812, document information, video information and so forth.

A reference numeral 1811 denotes a keyboard portion inputting document information or various commands. A reference numeral 1812 denotes the external storage device employing a floppy disc or hard disc drive as storage medium. In the external storage device 1812, document information, music or speech information, application program of the user and so forth are stored.

Figure 10:
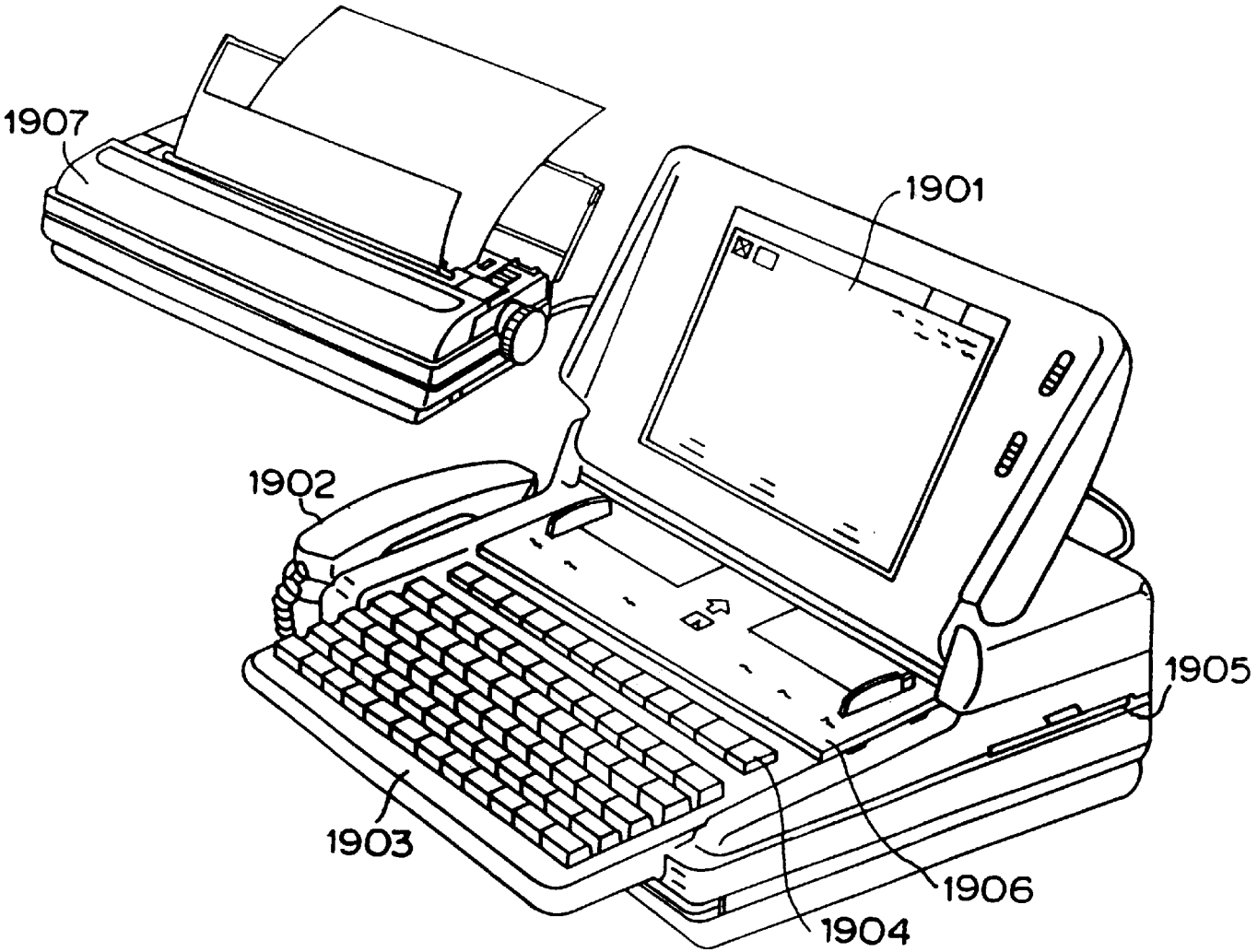
FIG. 10 is a schematic outside drawing showing an example of the information processor illustrated in FIG. 9.

FIG. 10 is a diagrammatic external view of the information processing system shown in FIG. 9.

In FIG. 10, a reference numeral 1901 denotes a flat panel display utilizing a liquid crystal and so forth. On this display, the touch panel 1803 is overlaid so that coordinate position input or item designation input can be performed by depressing the surface of the touch panel 1803 by a finger or so forth. A reference numeral 1902 denotes a handset to be used when a function as the telephone machine of the apparatus is used. A keyboard is detachably connected to a main body of the apparatus through a cable and adapted to permit entry of various document information or various data input. On the other hand, on the keyboard 1903, various function keys and so forth are arranged. A reference numeral 1905 denotes an insertion mouth of the external storage device 1812 for accommodating a floppy disk inserted thereinto.

A reference numeral 1906 denotes a paper stacking portion for stacking the original to be read by the image reader portion 1807. The original read by the image reader portion is discharged from the back portion of the apparatus. On the other hand, in facsimile reception, the received information is printed by the ink-jet printer 1907.

It should be noted that while the display portion 1802 may be a CRT, it is desirable to employ a flat display panel, such as a liquid crystal display employing a ferrodielectric liquid crystal for capability of down-sizing and reduction of thickness as well as reduction of weight.

When the information processing apparatus as set forth apparatus is operated as the personal computer or the wordprocessor, various information input through the keyboard portion 1811 is processed according to a predetermined program by the control portion 1801 and output as printed image by the printer portion 1806.

When the information processing apparatus is operated as a receiver of the facsimile machine, facsimile information input from the FAX transmission and reception portion 1808 via a communication network is subject reception process according to the predetermined program and output as received image by the printer portion 1808.

In addition, when the information processing apparatus is operated as a copy machine, the original is read by the image reader portion 1807 and the read original data is output to the printer portion as copy image via the control portion 1801. It should be noted that, when the information processing apparatus is used as the transmitter of the facsimile machine, the original data read by the image reader 1807 is processed for transmission according to the predetermined program by the control portion, and thereafter transmitted to the communication network via the FAX transmission and reception portion 1808.

Figure 11:
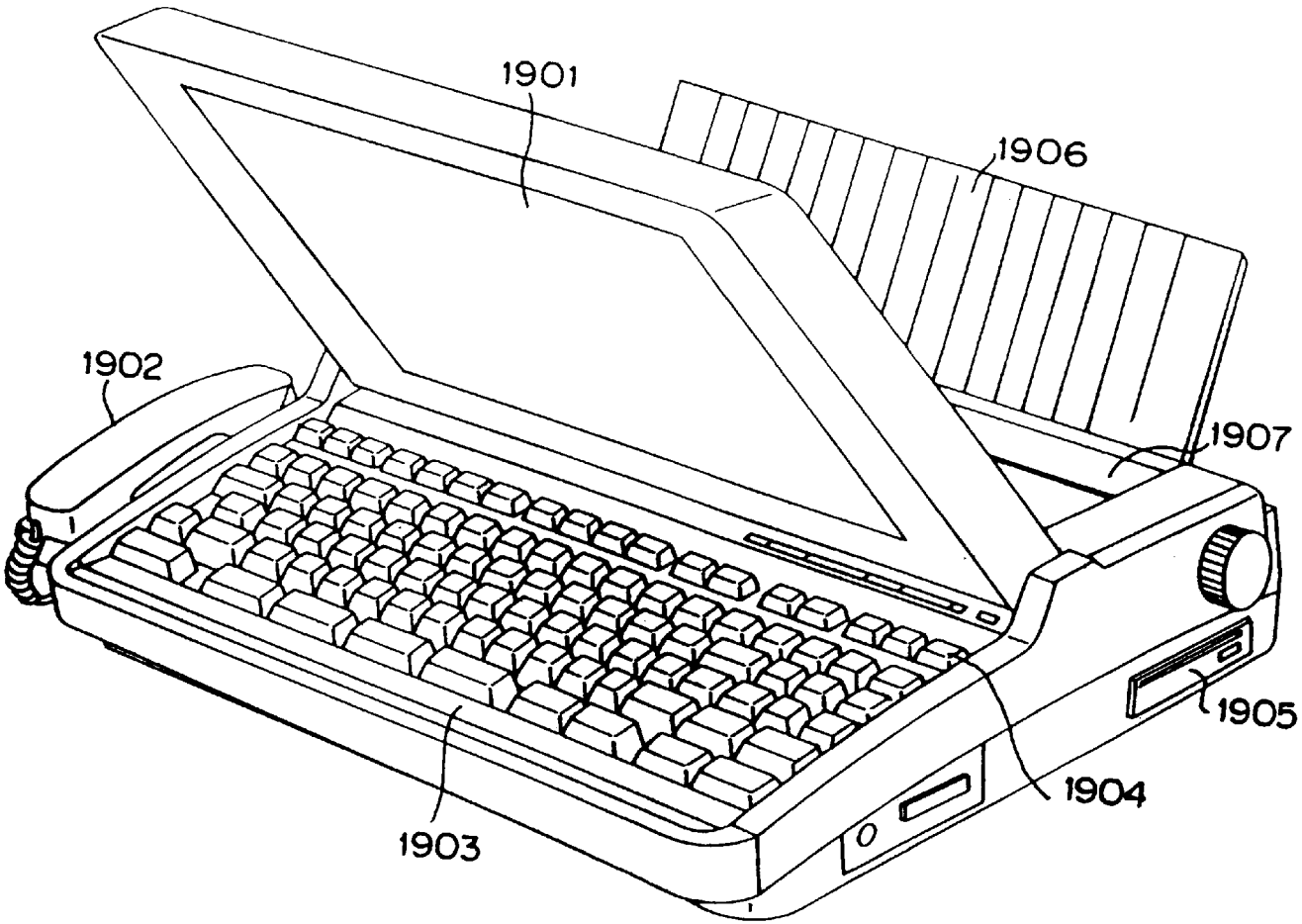
FIG. 11 is a schematic outside drawing of a structural example in which an ink jet printer is applied to the body of the information processor illustrated in FIG. 9.

It should be noted that the information processing apparatus may be an integrated type incorporating the ink-jet printer within a main body as illustrated in FIG. 11. In this case, portability can be further improved. In FIG. 11, the portions having the same function to FIG. 10 are shown with the corresponding reference numerals.

As set forth above, a multi-function type information processing apparatus may obtain high quality printed image at high speed and low noise by employing the printing apparatus of the present invention. Therefore, the functions of the information processing apparatus can be further enhanced.

As described above, the ink jet recording method of the present invention and the recording apparatus adopting this recording method involve heating a record material, fed to the recording apparatus, to a temperature range which is not lower than the transition temperature or the cloud point of a substance having thickening properties when undergoing heat contained in ink, and/or a substance having a cloud point, but which is below a temperature at which the record material deteriorates; ejecting ink from an ink ejection orifice of a recording head toward the record material fed to the recording apparatus, to perform recording, the ink containing a substance having thickening properties when undergoing heat, and/or a substance having a cloud point, in this predetermined temperature range; and controlling the temperature of the surroundings of the ink ejection orifice of the recording head to lie within a predetermined range so as to prevent the ejection state of the recording head from being hampered owing to the rise in the temperature of the surroundings of the ink ejection orifice of the recording head caused by radiant heat from the controlled-heated record material. This contrivance prevents the polymer from, say, gelling to precipitate, or thickening to adhere, due to excessive heat, onto the surroundings of the ink ejection orifice of the recording head. Thus, the properties of the ink related to the present invention can be exhibited fully to obtain a record with high color expression.

Particularly, a high degree of color development can be achieved, and feathering and color mixing can be prevented, when plain paper for office work, such as electrophotographic paper, is used.

Furthermore, even when a record material other than plain paper is used, a fully fixed image can be recorded without influence from the rough surface of the record material. The present invention has been described in detail with respect to the preferred embodiments, and it will now be clear that changes and modifications may be made without departing from the invention in its broader aspects, and it is our intention, therefore, in the appended claims to cover all such changes and modifications as full within the true spirit of the invention.

What is claimed is:

1. An ink jet recording method comprising the steps of:

controlling a temperature of a record material by heating the record material, fed to a recording apparatus, to fall within a predetermined temperature range, and ejecting ink from an ink ejection orifice of a recording head toward the record material fed to the recording apparatus, to perform recording, wherein a temperature of surroundings of the ink ejection orifice of the recording head is varied by radiant heat from the controlled-heated record material when the recording head resides at a position opposed to the heated record material, and a duration for which the recording head resides at a position opposed to the heated record material is controlled such that the temperature of the surroundings of the ink ejection orifice of the recording head falls within a predetermined range.

2. The ink jet recording method as claimed in claim 1, wherein the ink is an ink containing at least one of a substance having thickening properties when undergoing heat in the predetermined temperature range, and a substance having a cloud point in the predetermined temperature range.

3. The ink jet recording method as claimed in claim 2, wherein the recording apparatus comprises a capping member and wherein when a duration of residence of the recording head at a position opposed to the controlled-heated record material during recording reaches a time in which the temperature of the surroundings of the ink ejection orifice of the recording head rises to a temperature at which a viscosity of at least one of the substance having thickening properties when undergoing heat contained in the ink and the substance having a cloud point sharply increases, an ink ejection orifice surface of the recording head is capped with the capping member.

4. The ink jet recording method as claimed in claim 2, wherein the recording apparatus comprises a material having high heat-absorbing properties and wherein when a duration of residence of the recording head at a position opposed to the controlled-heated record material during recording reaches a time in which the temperature of the surroundings of the ink ejection orifice of the recording head rises to a temperature at which a viscosity of at least one of the substance having thickening properties when undergoing heat contained in the ink and the substance having a cloud point sharply increases, an ink ejection orifice surface of the recording head is capped by the material having high heat-absorbing properties, and then the ink whose temperature has not increased is sucked and/or ejected from the ink ejection orifice to cool the surroundings of the ink ejection orifice.

5. The ink jet recording method as claimed in claim 2, wherein the substance having thickening properties when undergoing heat is a thermally reversible type thickening polymer whose aqueous solution or aqueous suspension thickens at a certain temperature or higher, and whose temperature-viscosity relationship is reversible.

6. The ink jet recording method as claimed in claim 5, wherein the thermally reversible type thickening polymer is a water-soluble vinyl polymer containing 50% by weight or more of a vinyl carboxylic acid ester of an alkylene oxide adduct of an active hydrogen compound having a nitrogen-containing ring.

7. The ink jet recording method as claimed in claim 2, wherein the substance having a cloud point is a nonionic surfactant.

8. The ink jet recording method as claimed in claim 2, wherein the predetermined temperature range in which the record material is controlled-heated is not lower than a transition temperature or the cloud point of at least one of the substance having thickening properties when undergoing heat, and the substance having a cloud point, but below a temperature at which the record material deteriorates.

9. The ink jet recording method as claimed in claim 8, wherein the temperature of the ink, before being ejected from the recording head, is below the transition temperature or the cloud point of at least one of the substance having thickening properties when undergoing heat, and the substance having a cloud point.

10. The ink jet recording method as claimed in claim 1, wherein the recording head has a structure to be driven by heat energy to eject the ink, and the temperature of the surroundings of the ink ejection orifice of the recording head is also raised by heat generation associated with the ejection of the ink.

11. The ink jet recording method as claimed in claim 1, wherein the ink contains a coloring material comprising a dye or a pigment, and a liquid medium.

12. The ink jet recording method as claimed in claim 1, 2 or 9, wherein the recording head ejects the ink as an ink droplet from the ink ejection orifice by the action of mechanical energy.

13. An ink jet recording apparatus comprising:

transport means for guiding a record material to a position of recording and discharging the recording material after recording;

record material heating means for controlling a temperature of the record material guided to the position of recording by the transport means to fall within a predetermined temperature range;

a recording head for ejecting ink from an ink ejection orifice of the recording head toward the record material transported by the transport means to perform recording, wherein a temperature of surroundings of the ink ejection orifice is varied by radiant heat from the heated record material when the recording head resides at a position opposed to the heated record material;

head residence time measuring means coupled to at least one of the recording head and the transport means for measuring a duration for which the recording head resides at a position opposed to the controlled-heated record material to perform recording; and control means coupled to the head residence time measuring means and the recording head for controlling the duration of residence of the recording head at the position opposed to the controlled-heated record material such that the temperature of surroundings of the ink ejection orifice of the recording head falls within a predetermined range wherein a viscosity of the ink does not sharply increase.

14. The ink jet recording apparatus as claimed in claim 13, wherein the ink is an ink containing at least one of a substance having thickening properties when undergoing heat and a substance having a cloud point.

15. The ink jet recording apparatus as claimed in claim 14, further comprising a capping member and wherein when the duration of residing of the recording head at a position opposed to the controlled-heated record material during recording reaches a time in which the temperature of the surroundings of the ink ejection orifice of the recording head rises to a temperature at which the viscosity of at least one of the substance having thickening properties when undergoing heat contained in the ink and the substance having a cloud point sharply increases, the ink ejection orifice surface of the recording head is capped by the capping member.

16. The ink jet recording apparatus as claimed in claim 14, further comprising a capping member and wherein the duration of residence of the recording head at a position opposed to the controlled-heated record material during recording reaches a time in which the temperature of the surroundings of the ink ejection orifice of the recording head rises to a temperature at which the viscosity of the substance having thickening properties when undergoing heat contained in the ink and/or the substance having a cloud point sharply increases, the ink ejection orifice surface of the recording head is capped by the capping member, and then the ink whose temperature has not increased is sucked and/or ejected from the ink ejection orifice to cool the surroundings of the ink ejection orifice.

17. The ink jet recording apparatus as claimed in claim 14, wherein the substance having thickening properties when undergoing heat is a thermally reversible type thickening polymer whose aqueous solution or aqueous suspension thickens at a certain temperature or higher, and whose temperature-viscosity relationship is reversible.

18. The ink jet recording apparatus as claimed in claim 17, wherein the thermally reversible type thickening polymer is a water-soluble vinyl polymer containing 50% by weight or more of a vinyl carboxylic acid ester of an alkylene oxide adduct of an active hydrogen compound having a nitrogen-containing ring.

19. The ink jet recording apparatus as claimed in claim 14, wherein the substance having a cloud point is a nonionic surfactant.

20. The ink jet recording apparatus as claimed in claim 14, wherein the predetermined temperature range in which the record material is controlled-heated is not lower than a transition temperature or the cloud point of at least one of the substance having thickening properties when undergoing heat, and the substance having a cloud point, but below a temperature at which the record material deteriorates.

21. The ink jet recording apparatus as claimed in claim 20, wherein a temperature of the ink, before being ejected from the recording head, is below the transition temperature or the cloud point of at least one of the substance having thickening properties when undergoing heat, and the substance having a cloud point.

22. The ink jet recording apparatus as claimed in claim 13, wherein the ink contains a coloring material comprising a dye or a pigment, and a liquid medium.

23. The ink jet recording apparatus as claimed in claim 13, wherein the recording head ejects the ink as an ink droplet from the ink ejection orifice by the action of heat energy.

24. The ink jet recording apparatus as claimed in claim 13, wherein the recording head ejects the ink as an ink droplet from the ink ejection orifice by the action of mechanical energy.

* * * * *

UNITED STATES PATENT AND TRADEMARK OFFICE

CERTIFICATE OF CORRECTION

PATENT NO. : 6,186,612 B1
DATED : February 13, 2001
INVENTOR(S) : Hiroyuki Maeda et al.

It is certified that error appears in the above-identified patent and that said Letters Patent is hereby corrected as shown below:

Column 2,
Line 26, “controlled heating” should read -- controlled heating of --.

Column 3,
Line 26, “4-4’” should read -- 4-4’ in --.

Column 16,
Line 18, “are” should read -- is --.

Column 17,
Line 18, “consists” should read -- consist --.

Column 18,
Line 52, “document,” should read -- documents, --; and “as” should read -- as an --.

Column 19,
Line 34, “apparatus” should be deleted.
Line 42, “subject” should read -- subject to a --.

Column 20,
Line 39, “full” should read -- fall --.

Signed and Sealed this

Third Day of August, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,186,612 B1
DATED : February 13, 2001
INVENTOR(S) : Hiroyuki Maeda et al.

It is certified that error appears in the above-identified patent and that said Letters Patent is hereby corrected as shown below:

Column 2,
Line 26, “controlled heating” should read -- controlled heating of --.

Column 3,
Line 26, “4-4’” should read -- 4-4’ in --.

Column 16,
Line 18, “are” should read -- is --.

Column 17,
Line 18, “consists” should read -- consist --.

Column 18,
Line 52, “document,” should read -- documents, --; and “as” should read -- as an --.

Column 19,
Line 34, “apparatus” should be deleted.
Line 42, “subject” should read -- subject to a --.

Column 20,
Line 39, “full” should read -- fall --.

Signed and Sealed this

Seventh Day of September, 2004

JON W. DUDAS
*Acting Director of the United States Patent and Trademark Office*